US010845733B2

(12) United States Patent
Park et al.

(10) Patent No.: US 10,845,733 B2
(45) Date of Patent: Nov. 24, 2020

(54) DEVELOPER CIRCULATOR TO GUIDE DEVELOPER

(71) Applicant: HEWLETT-PACKARD DEVELOPMENT COMPANY, L.P., Spring, TX (US)

(72) Inventors: Jong Hyun Park, Suwon (KR); Jong Hwa Park, Suwon (KR); Jang Hyun Son, Suwon (KR); Dong Geun Lee, Suwon (KR); Jeong Hyun Lee, Suwon (KR); Min Su Han, Pangyo (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/609,468

(22) PCT Filed: Mar. 19, 2018

(86) PCT No.: PCT/KR2018/003138
§ 371 (c)(1),
(2) Date: Oct. 30, 2019

(87) PCT Pub. No.: WO2019/066171
PCT Pub. Date: Apr. 4, 2019

(65) Prior Publication Data

US 2020/0192245 A1 Jun. 18, 2020

(30) Foreign Application Priority Data

Sep. 27, 2017 (KR) ..... 10-2017-0125416

(51) Int. Cl.
*G03G 15/08* (2006.01)

(52) U.S. Cl.
CPC ..... *G03G 15/0891* (2013.01); *G03G 15/0808* (2013.01); *G03G 2215/0827* (2013.01)

(58) Field of Classification Search
CPC ..... G03G 15/0808; G03G 15/0827; G03G 15/0891; G03G 21/10; G03G 21/105
See application file for complete search history.

(56) References Cited

U.S. PATENT DOCUMENTS 5,592,270 A * 1/1997 Takai ..... G03G 15/0844 399/260
7,529,510 B2 * 5/2009 Hirota ..... G03G 15/0893 399/258

(Continued)

FOREIGN PATENT DOCUMENTS

JP 1999-119531 4/1999
JP 2001-255743 9/2001

(Continued)

*Primary Examiner* — David J Bolduc
(74) *Attorney, Agent, or Firm* — Trop Pruner & Hu, P.C.

(57) ABSTRACT

A developing device comprising a developer transporting unit including a developer inlet through which a developer is reintroduced, a developer outlet through which the developer is discharged, and a developing roller mounted in the developer transporting unit; and a developer circulator including a first connection opening connected to the developer outlet, to receive the developer discharged through the developer outlet, a second connection opening connected to the developer inlet to reintroduce the developer through the developer inlet into the developer transporting unit, a waste opening through which the developer is discarded, and a guide member mounted in the developer circulator to selectively guide the developer received through the first connection opening to the second connection opening or to the waste opening.

18 Claims, 8 Drawing Sheets

(56) References Cited

U.S. PATENT DOCUMENTS

2003/0219283 A1 11/2003 Tamura
2008/0075483 A1* 3/2008 Bito ..... G03G 21/12 399/35
2008/0199205 A1* 8/2008 Kubo ..... G03G 15/0898 399/92
2008/0199223 A1* 8/2008 Tateyama ..... G03G 15/0822 399/254
2010/0239340 A1* 9/2010 Akaike ..... G03G 21/105 399/358
2011/0103857 A1 5/2011 Ohta
2011/0194863 A1* 8/2011 Matsumoto ..... G03G 15/0822 399/27
2011/0229209 A1* 9/2011 Takaya ..... G03G 15/0844 399/257
2012/0189349 A1* 7/2012 Okuno ..... G03G 15/0189 399/254
2013/0259495 A1 10/2013 Ota
2014/0161490 A1* 6/2014 Yamane ..... G03G 15/0887 399/257
2015/0177648 A1* 6/2015 Morishita ..... G03G 15/0886 399/358
2015/0212452 A1* 7/2015 Ohgoshi ..... G03G 15/0879 399/262
2015/0301477 A1* 10/2015 Akedo ..... G03G 15/0893 399/254
2015/0323886 A1* 11/2015 Mandai ..... G03G 15/0891 399/254
2016/0033927 A1* 2/2016 Sato ..... G03G 21/0011 399/110
2016/0091823 A1* 3/2016 Kitajima ..... G03G 15/0893 399/260
2016/0147179 A1* 5/2016 Lee ..... G03G 21/12 399/257
2016/0154342 A1* 6/2016 Saito ..... G03G 15/0891 399/254
2017/0336733 A1* 11/2017 Adachi ..... G03G 15/0889
2018/0157192 A1* 6/2018 Oikawa ..... G03G 15/0844

FOREIGN PATENT DOCUMENTS

JP 3432673 5/2003
JP 2005202317 7/2005
JP 2008065229 3/2008
KR 10-0869979 11/2008

* cited by examiner

[Fig. 1]
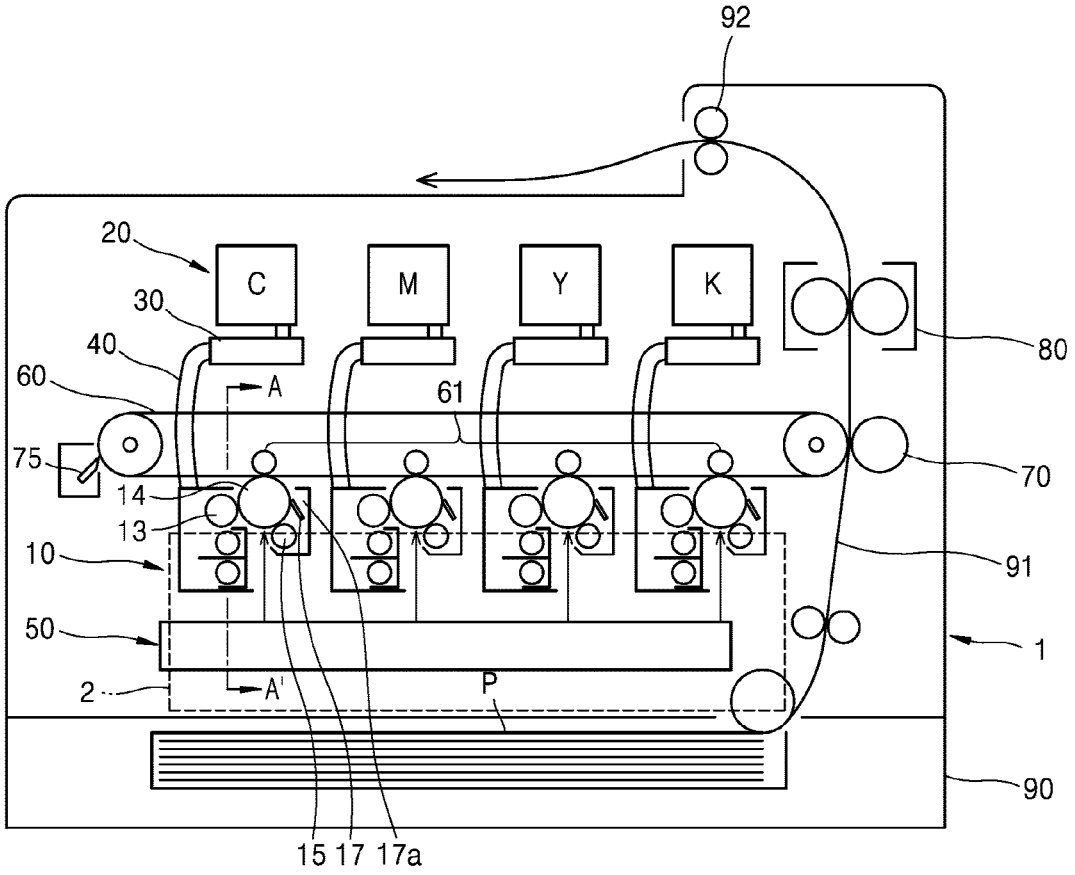

[Fig. 2]
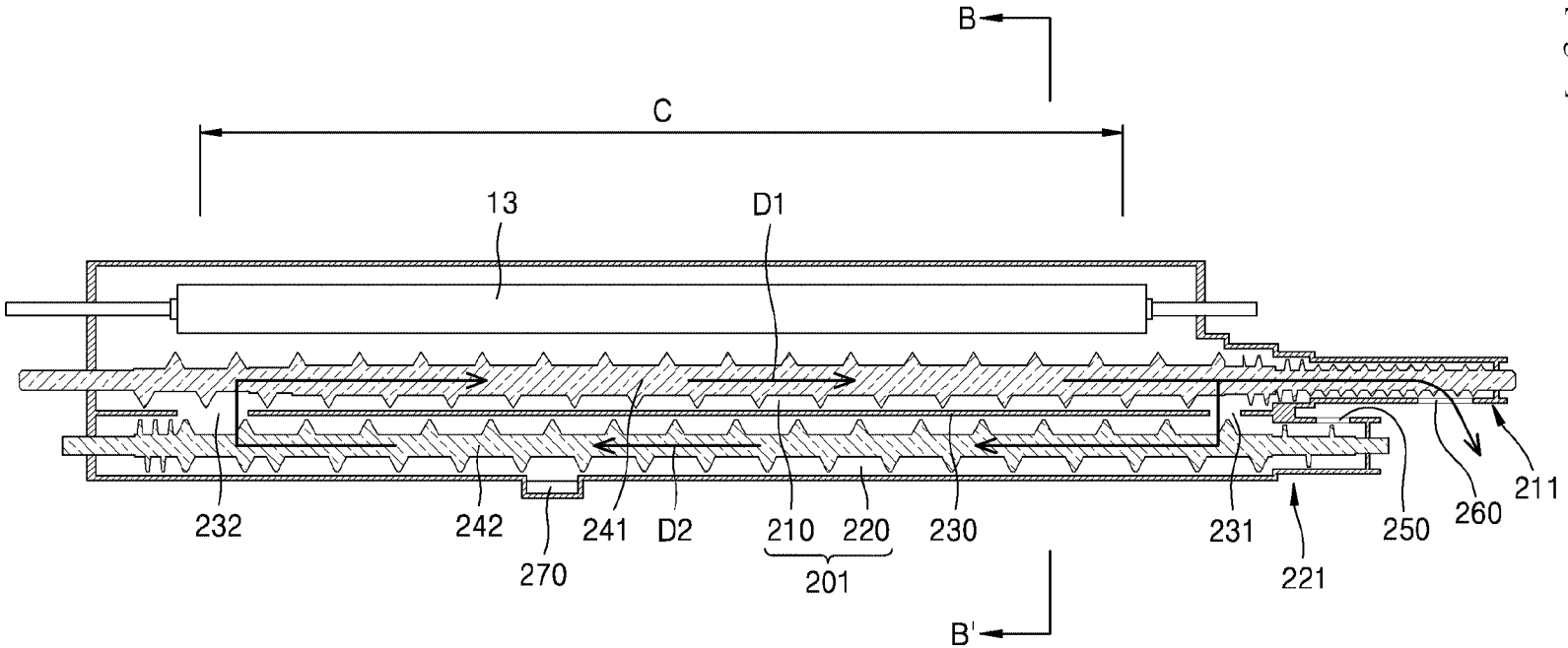

[Fig. 3]
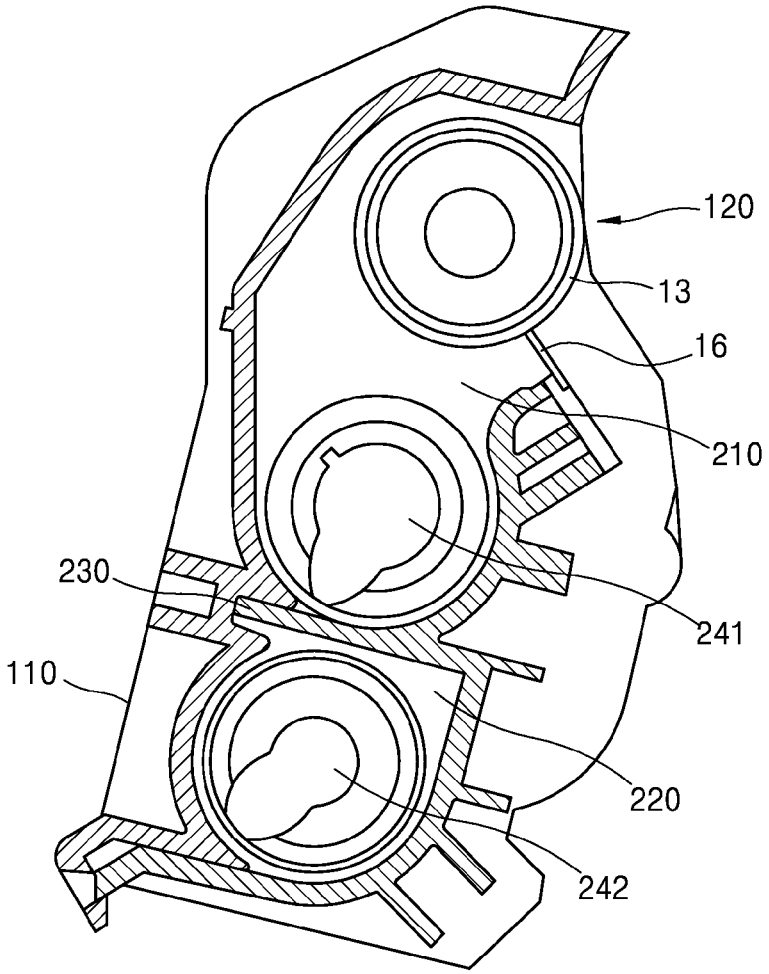

[Fig. 4]
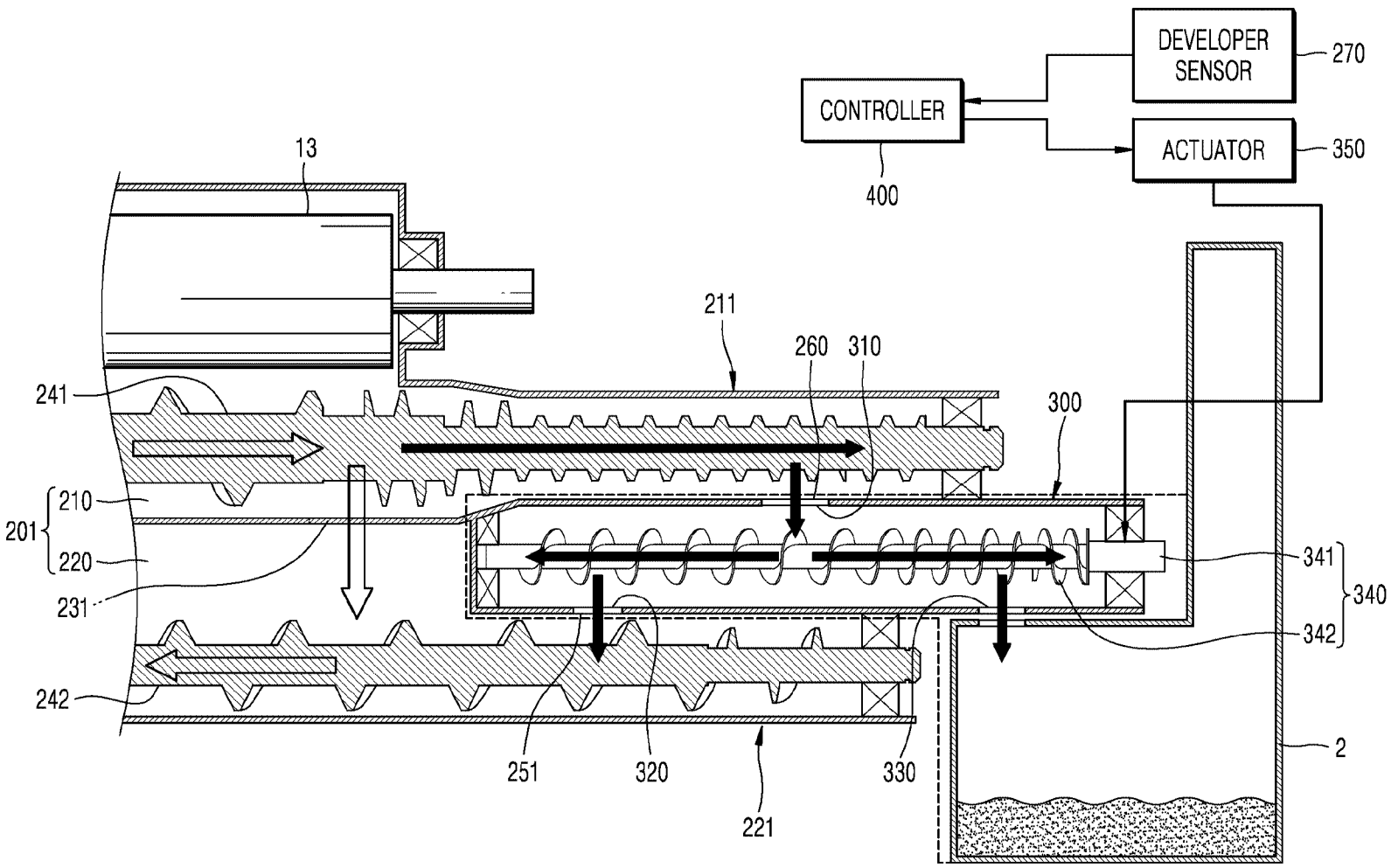

[Fig. 5]
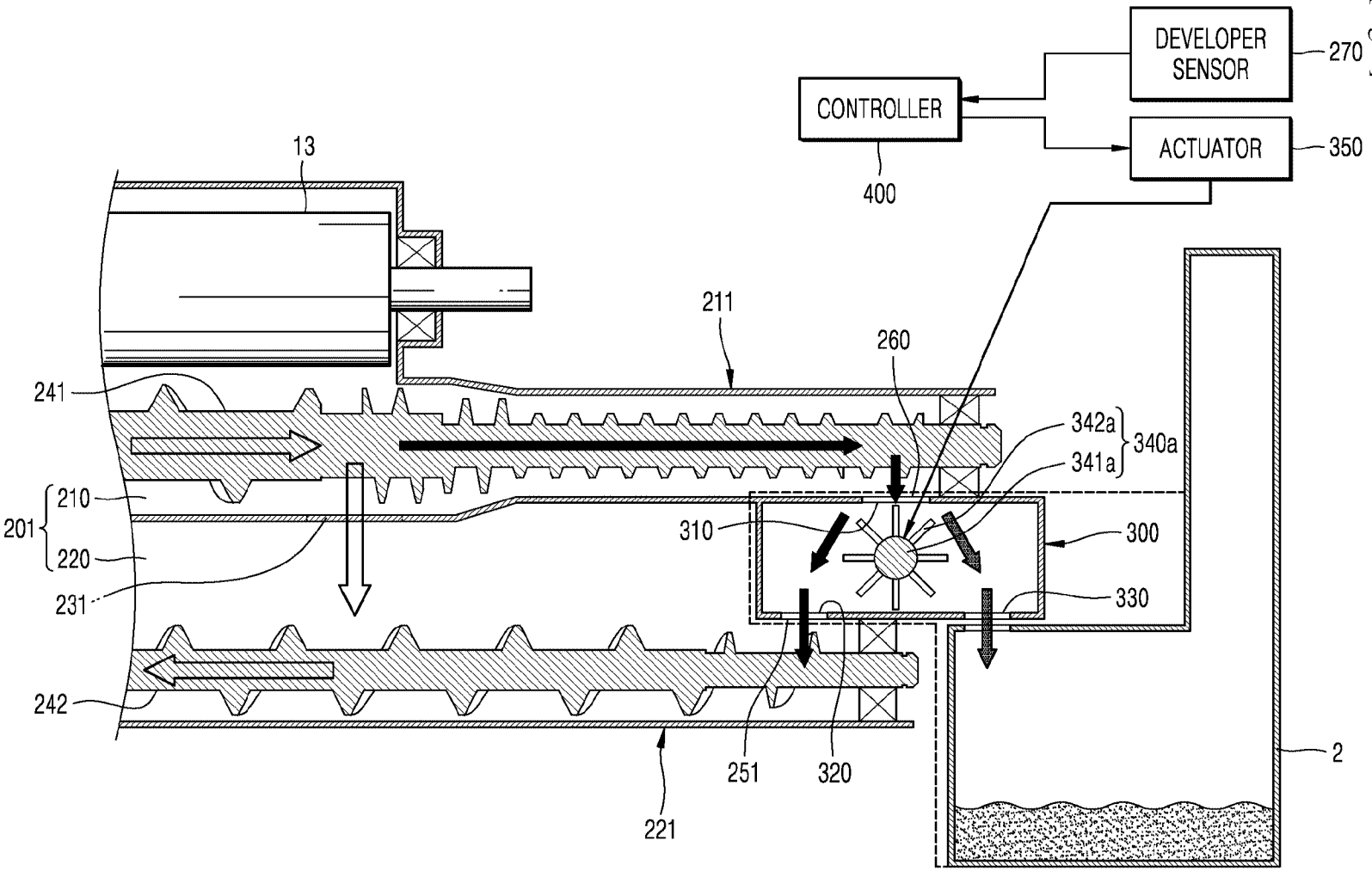

[Fig. 6]
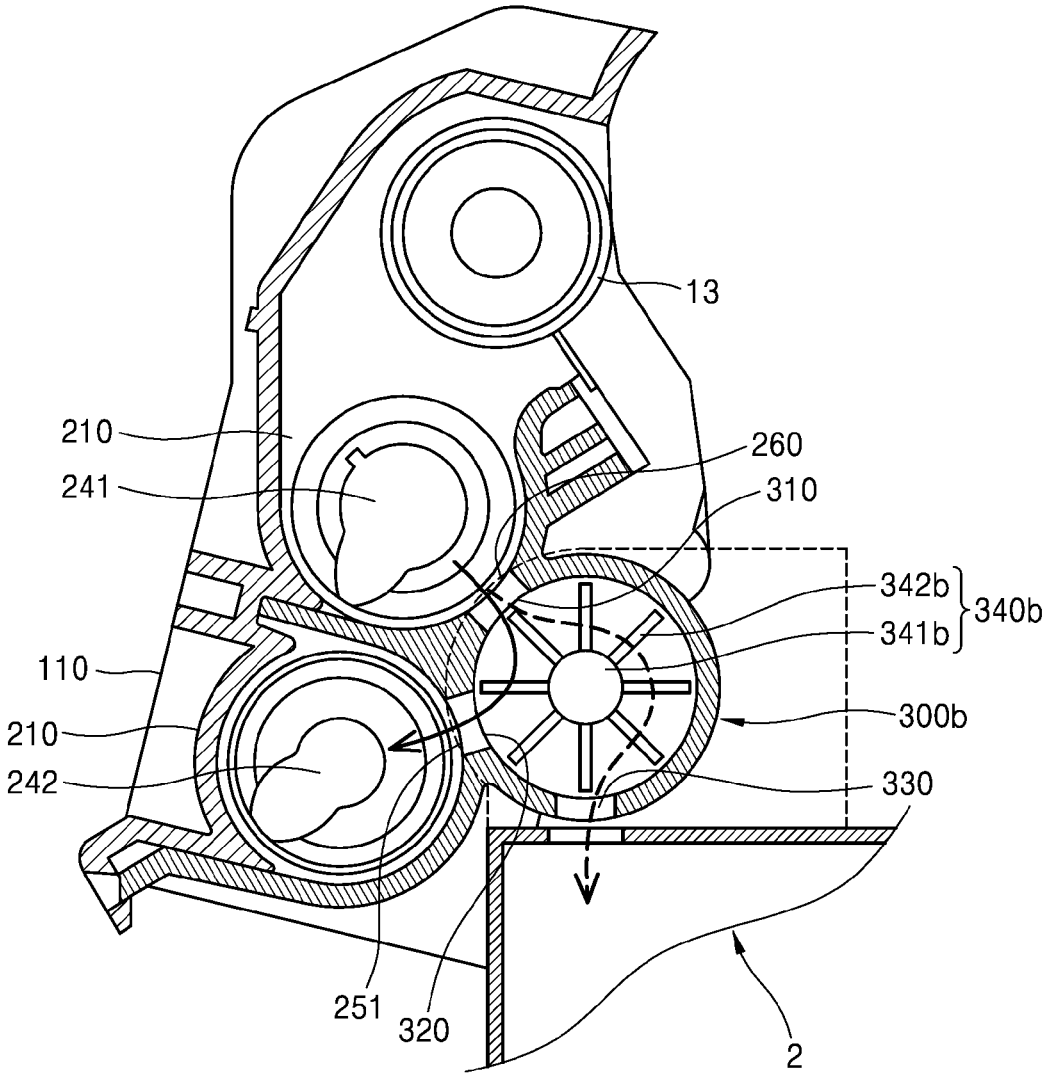

[Fig. 7]
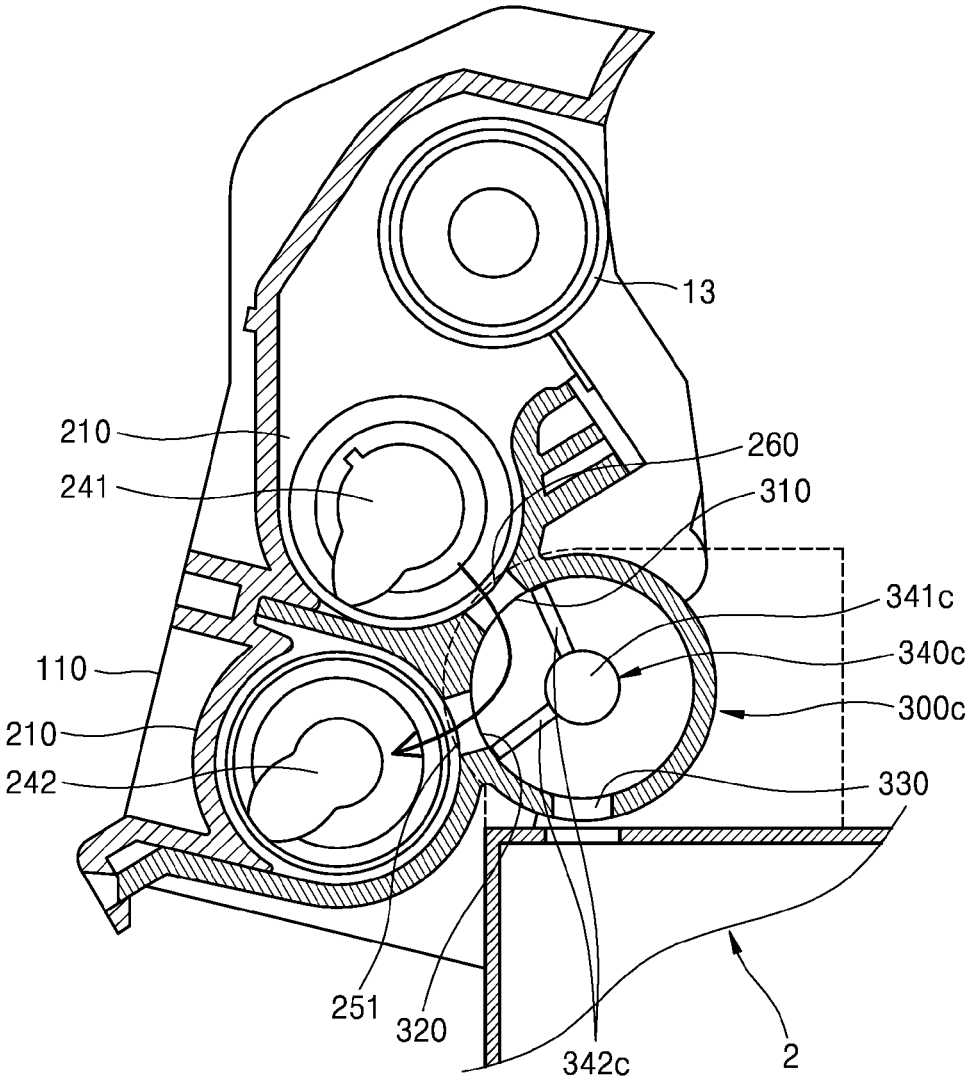

[Fig. 8]
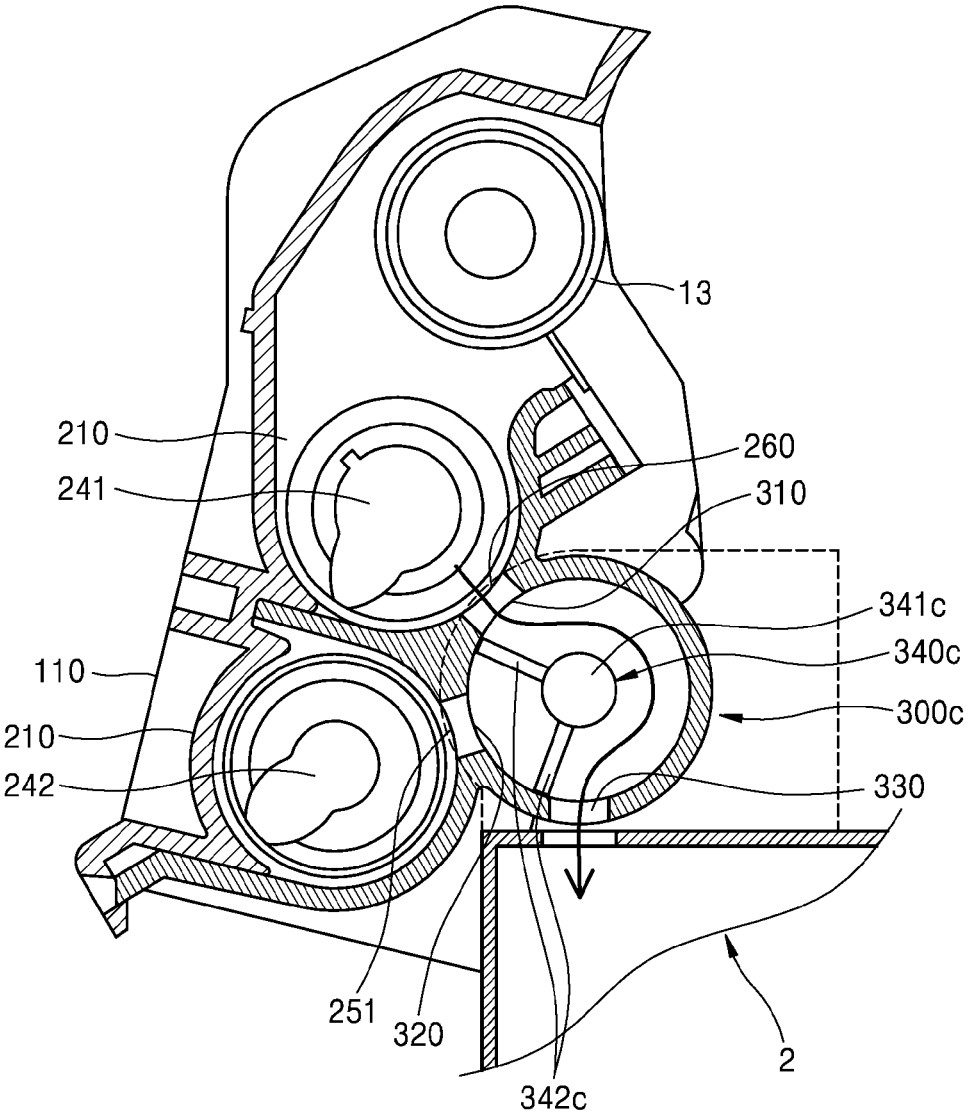

DEVELOPER CIRCULATOR TO GUIDE DEVELOPER

BACKGROUND ART

An image forming apparatus using an electrophotographic method supplies toner to an electrostatic latent image formed on a photosensitive body to form a toner image on the photosensitive body, transfers the toner image onto a recording medium, and fixes the transferred toner image on the recording medium so as to print an image on the recording medium. A developing device accommodates the toner, and supplies the toner to the electrostatic latent image formed on the photosensitive body to form the visible toner image on the photosensitive body.

Examples of a development method include a monocomponent development method in which only the toner is used as a developer, and a dual-component development method in which the toner and a carrier are used as a developer. When the dual-component development method is used, the performance of carriers in a developing device is degraded due to repetitive use. To counteract this, a trickle development method in which a new developer is supplied into the developing device, and a residual developer is discharged from the developing device, may be used.

BRIEF DESCRIPTION OF DRAWINGS

FIG. 1 is a schematic structural diagram of an electrophotographic image forming apparatus according to an example;

FIG. 2 is a cross-sectional view of a developing device illustrated in FIG. 1 taken along a line A-A', according to an example;

FIG. 3 is a cross-sectional view of the developing device illustrated in FIG. 2 taken along a line B-B';

FIG. 4 is a schematic structural diagram of a structure for reducing fluctuation in an amount of developer, according to an example;

FIG. 5 is a schematic structural diagram of a structure for reducing fluctuation in an amount of developer, according to another example;

FIG. 6 is a schematic structural diagram of a structure for reducing fluctuation in an amount of developer, according to another example; and FIGS. 7 and 8 are structural diagrams of a structure for reducing fluctuation in an amount of developer, according to other examples, wherein FIG. 7 illustrates a valve member located at a first position, and FIG. 8 illustrates a valve member located at a second position.

MODE FOR THE INVENTION

Hereinafter, a developing device and an electrophotographic image forming apparatus including the developing device will be described with regard to examples of the present disclosure with reference to the attached drawings. In the present specification and the drawings, elements having substantially the same functions will be labeled like reference numerals to omit repeated description.

FIG. 1 is a schematic structural diagram of an electrophotographic image forming apparatus according to an example. The electrophotographic image forming apparatus according to the present example prints a color image by using an electrophotographic method. The image forming apparatus according to the present example is a color image forming apparatus. Referring to FIG. 1, the image forming apparatus includes a plurality of developing devices 10, an exposure device 50, a transfer device, and a fixing device 80.

The image forming apparatus may further include a plurality of developer cartridges 20 accommodating a developer. The plurality of developer cartridges 20 are respectively connected to the plurality of developing devices 10, and the developer accommodated in the plurality of developer cartridges 20 is supplied to each of the developing devices 10. The plurality of developer cartridges 20 and the plurality of developing devices 10 are attachable to and detachable from a main body 1 and are individually replaceable.

The plurality of developing devices 10 may include a plurality of developing devices 10C, 10M, 10Y, and 10K that are used to form toner images of cyan (C), magenta (M), yellow (Y), and black (K) colors. In addition, the plurality of developer cartridges 20 may include a plurality of developer cartridges 20C, 20M, 20Y, and 20K respectively accommodating developers of cyan (C), magenta (M), yellow (Y), and black (K) colors to be supplied to the plurality of developing devices 10C, 10M, 10Y, and 10K. However, the scope of the present disclosure is not limited thereto, and developer cartridges 20 and developing devices 10 may be further included to accommodate and develop developers of other various colors such as light magenta or white in addition to the above-described colors. Hereinafter, an image forming apparatus including the plurality of developing devices 10C, 10M, 10Y, and 10K and the plurality of developer cartridges 20C, 20M, 20Y, and 20K will be described, and unless otherwise described, elements labeled C, M, Y, or K below respectively refer to elements for developing developers of cyan (C), magenta (M), yellow (Y), and black (K) colors.

The developing devices 10 may each include a photosensitive drum 14, on a surface of which an electrostatic latent image is formed, and a developing roller 13 supplying a developer to the electrostatic latent image to develop the electrostatic latent image into a visible toner image. The photosensitive drum 14 is an example of a photosensitive body, on a surface of which an electrostatic latent image is formed, and may include a conductive metal pipe and a photosensitive layer formed on an outer circumference thereof. A charging roller 15 is an example of a charging device charging the photosensitive drum 14 to have a uniform surface potential. Instead of the charging roller 15, a charging brush or a corona charging device or the like may also be used.

The developing devices 10 may further include a charging roller cleaner (not illustrated) removing a developer or foreign substances such as dust attached on the charging roller 15, a cleaning member 17 removing a developer remaining on a surface of the photosensitive drum 14 after an intermediate transfer process to be described later, a regulation member regulating an amount of a developer supplied to a developing region in which the photosensitive drum 14 and the developing roller 13 face each other. Waste developer is accommodated in a waste developer accommodating unit 17*a*. The cleaning member 17 may be, for example, a cleaning blade that contacts a surface of the photosensitive drum 14 to scrape the developer. Although not illustrated in FIG. 1, the cleaning member 17 may be a cleaning brush that rotates to contact a surface of the photosensitive drum 14 and scrape the developer. Waste developer accommodated in the waste developer accommodating unit 17*a* may be transported to and accommodated in a waste developer container 2 by using a transporting unit (not shown).

A developer accommodated in the developer cartridge 20, that is, toner and carrier, is supplied to the developing device 10. The developing roller 13 is spaced apart from the photosensitive drum 14. A distance between an outer circumferential surface of the developing roller 13 and an outer circumferential surface of the photosensitive drum 14 may be, for example, several tens to about several hundreds of microns. The developing roller 13 may be a magnetic roller. In addition, the developing roller 13 may have a form in which a magnet is disposed in a rotating developing sleeve. In the developing device 10, toner is mixed with a carrier, and the toner is attached to a surface of a magnetic carrier. The magnetic carrier is attached to a surface of the developing roller 13 and transported to the developing region in which the photosensitive drum 14 and the developing roller 13 face each other. A regulating member 16 (FIG. 3) regulates an amount of the developer transported to the developing region. Via a developing bias voltage applied between the developing roller 13 and the photosensitive drum 14, only the toner is supplied to the photosensitive drum 14 so as to develop an electrostatic latent image formed on a surface of the photosensitive drum 14 into a visible toner image. A trickle development method is used in the developing device 10 according to the present example. In order to maintain a uniform amount of developer in the developing device 10, residual developer is discharged out of the developing device 10. The residual developer discharged out of the developing device 10 may be accommodated in the waste developer container 2. A configuration for discharging residual developer out of the developing device 10 will be described in detail later.

The exposure device 50 radiates light modulated according to image information, onto the photosensitive drum 14, to thereby form an electrostatic latent image on the photosensitive drum 14. Examples of the exposure device 50 may be a laser scanning unit (LSU) using a laser diode as a light source or a light-emitting diode (LED) exposure device that uses an LED as a light source.

The transfer device transfers the toner image formed on the photosensitive drum 14, onto a recording medium P. In the present example, a transfer device that uses an intermediate transfer method is used. For example, the transfer device may include an intermediate transfer belt 60, a plurality of intermediate transfer rollers 61, and a transfer roller 70.

The intermediate transfer belt 60 temporarily accommodates the toner image developed on the photosensitive drum 14 of the plurality of developing devices 10C, 10M, 10Y, and 10K. A plurality of intermediate transfer rollers 61 are disposed to face the photosensitive drum 14 of the plurality of developing devices 10C, 10M, 10Y, and 10K, with the intermediate transfer belt 60 therebetween. An intermediate transfer bias voltage used to intermediately transfer the toner image developed on the photosensitive drum 14, to the intermediate transfer belt 60, is applied to the plurality of intermediate transfer rollers 61. Instead of the intermediate transfer rollers 61, a corona transfer device or a pin scorotron transfer device may be used.

The transfer roller 70 is disposed to face the intermediate transfer belt 60. A transfer bias voltage for transferring the toner image transferred to the intermediate transfer belt 60, to the recording medium P, is applied to the transfer roller 70.

The fixing device 80 fixes the toner image transferred to the recording medium P, on the recording medium P, by applying heat and/or pressure to the toner image. The form of the fixing device 80 is not limited to that illustrated in FIG. 1.

According to the above-described configuration, the exposure device 50 radiates light modulated according to image information of the colors onto the photosensitive drum 14 of the plurality of developing devices 10C, 10M, 10Y, and 10K to form an electrostatic latent image on the photosensitive drum 14. The electrostatic latent image of the photosensitive drum 14 of the plurality of developing devices 10C, 10M, 10Y, and 10K is developed into a visible toner image by using the C, M, Y, and K developers supplied from the plurality of developer cartridges 20C, 20M, 20Y, and 20K to the plurality of developing devices 10C, 10M, 10Y, and 10K. The developed toner images are sequentially intermediately transferred to the intermediate transfer belt 60. The recording medium P loaded in a feeding unit 90 is transported along a feeding path 91 between the transfer roller 70 and the intermediate transfer belt 60. Due to a transfer bias voltage applied to the transfer roller 70, the toner images that are intermediately transferred onto the intermediate transfer belt 60 are transferred to the recording medium P. When the recording medium P passes through the fixing device 80, the toner images are fixed to the recording medium P by heat and pressure. The recording medium P, with which fixing is completed, is discharged using a discharge roller 92.

The developer accommodated in the developer cartridge 20 is supplied to the developing device 10. When the developer accommodated in the developer cartridge 20 is completely consumed, the developer cartridge 20 may be replaced with a new developer cartridge 20, or a new developer may be filled in the developer cartridge 20.

The image forming apparatus may further include a developer supply unit 30. The developer supply unit 30 receives a developer from the developer cartridge 20 and supplies the same to the developing device 10. The developer supply unit 30 is connected to the developing device 10 via a supply pipe line 40. Although not illustrated in FIG. 1, the developer supply unit 30 may be omitted, and the supply pipe line 40 may directly connect the developer cartridge 20 and the developing device 10.

FIG. 2 is a cross-sectional view of the developing device 10 illustrated in FIG. 1 taken along a line A-A', according to an example. FIG. 3 is a cross-sectional view of the developing device 10 illustrated in FIG. 2 taken along a line B-B', according to an example.

Referring to FIGS. 2 and 3, the developing device 10 includes a development casing 110 and a developing roller 13 that is rotatably supported by the development casing 110. A developer is accommodated in the development casing 110. The developer may be supplied from the developer cartridge 20 as described above.

A developer transporting unit 201 may be included in the development casing 110. The developer is transported along the developer transporting unit 201, and is agitated. The developing roller 13 is mounted in the developer transporting unit 201.

The developer transporting unit 201 may include a developing chamber 210. An opening portion 120 opened towards the photosensitive drum 14 is formed in the developing chamber 210. The developing roller 13 is mounted in the developing chamber 210. The developing roller 13 is partially exposed out of the developing chamber 210 through the opening portion 120, and an exposed portion of the developing roller 13 faces the photosensitive drum 14. The developing roller 13 supplies the toner accommodated in the developing chamber 210 to an electrostatic latent image formed on the photosensitive drum 14, through the opening portion 120, thereby developing the electrostatic latent image into a toner image.

The developer transporting unit 201 may further include an agitating chamber 220. The agitating chamber 220 is divided from the developing chamber 210 via a barrier wall 230. First and second agitating members 241 and 242 may be included in the developing chamber 210 and the agitating chamber 220, respectively. The first and second agitating members 241 and 242 transport a developer in each of the developing chamber 210 and the agitating chamber 220 in a length direction of the developing roller 13, thereby agitating the toner and the carrier. The first and second agitating members 241 and 242 may be, for example, augers having spiral wings. The first and second agitating members 241 and 242 transport the developer in opposite directions to each other. For example, the first and second agitating members 241 and 242 may transport the developer in a first direction D1 and a second direction D2, respectively. First and second openings 231 and 232 are respectively formed in two end portions of the barrier wall 230 in a length direction, to thereby communicatively connect the developing chamber 210 and the agitating chamber 220. Accordingly, via the first agitating member 241, the developer in the developing chamber 210 is transported in the first direction D1. The developer is transported to the agitating chamber 220 through the first opening 231 formed in an end portion of the barrier wall 230 in the first direction D1. The developer in the agitating chamber 220 is transported by the second agitating member 242 in the second direction D2. The developer is transported to the developing chamber 210 through the second opening 232 formed in an end portion of the barrier wall 230 in the second direction D2. According to this configuration, the developer is circulated through a circulation passage in which the developing chamber 210, the first opening 231, the agitating chamber 220, the second opening 232, and the developing chamber 210 again are sequentially included. A portion of the developer transported in the developing chamber 210 in the first direction D1 is supplied to the photosensitive drum 14 via the developing roller 13.

The developing device 10 according to the present example includes a developer supply inlet 250. The developer may be supplied from the developer cartridge 20 through the developer supply inlet 250 into the developing device 10, that is, into the developer transporting unit 201. The developer supply inlet 250 may be provided in an outer portion of an effective image area C of the developing roller 13. The effective image area C refers to an area that is effectively used in forming an image, from a length of the developing roller 13. A length of the effective image area C may be slightly greater than a width of the recording medium P of an available maximum size. The effective image area C may be an inner portion with respect to the first opening 231 and the second opening 232. The developer supply inlet 250 may be located in an outer portion of the first opening 231 and the second opening 232.

According to an example, the developing device 10 may include a supply unit 221 extending from the developer transporting unit 201 in a length direction of the developing roller 13. The developer supply inlet 250 may be provided in the supply unit 221. For example, the supply unit 221 may extend from the agitating chamber 220 beyond the first opening 231 to an outer portion of the effective image area C in the first direction D1. The second agitating member 242 extends to an inner portion of the supply unit 221. The developer supplied to the agitating chamber 220 through the developer supply inlet 250 is transported in the second direction D2 by using the second agitating member 242. Although not illustrated in the drawings, the supply unit 221 may extend from the agitating chamber 220 beyond the second opening 232 in the second direction D2. In this case, a structure for transporting the developer in the first direction D1, for example, a reverse spiral wing, may be provided in an area of the second agitating member 242 corresponding to the supply unit 221. The developer supplied to the agitating chamber 220 through the developer supply inlet 250 may be transported in the first direction D1 via the reverse spiral wing, and then transported to the developing chamber 210 through the second opening 232.

The developing device 10 according to the present example, in which a trickle development method is used, includes a developer outlet 260. Residual developer is discharged out of the developing device 10 through the developer outlet 260. The discharged residual developer is accommodated in the waste developer container 2. The developer outlet 260 is located in an outer portion of the effective image area C of the developing roller 13. The developer outlet 260 may be located in an outer portion of the first opening 231 and the second opening 232.

According to an example, the developing device 10 may include a discharging unit 211 extending from the developer transporting unit 201 in a length direction of the developing roller 13. The developer outlet 260 may be provided in the discharging unit 211. For example, the discharging unit 211 may extend from the developing chamber 210 in the first direction D1 toward an outer portion of the effective image area C. The first agitating member 241 extends toward an inner portion of the discharging unit 211. Residual developer may be transported by the first agitating member 241 and discharged out of the developing device 10 through the developer outlet 260.

While the discharging unit 211 and the supply unit 221 are respectively provided in the developing chamber 210 and the agitating chamber 220 in FIG. 2, the discharging unit 211 and the supply unit 221 may also be provided in the agitating chamber 220 and the developing chamber 210, respectively.

In the developing device 10 that uses a trickle developing method, if an internal pressure of the developing device 10 reaches a predetermined level and is not maintained at that level, but fluctuates, or as the form of transporting or circulation of developer changes according to the period of use or the usage environment, the developer may be unstably discharged and reach a range where an amount of developer of the developing device 10 does not ensure printing quality.

For example, during high-speed printing, the internal pressure may excessively increase due to the air flowing into the developing device 10, thus discharging the developer excessively. The amount of discharged developer may increase due to deterioration of the characteristics of the developer due to its use over a long period of time or a change in the flow characteristics of the developer according to environmental conditions. For example, the amount of developer being discharged may excessively increase under low-temperature/low-humidity environmental conditions where fluidity of the developer is best, resulting in an insufficient amount of the developer in the developing device 10. On the contrary, if the internal pressure of the developing device 10 is low as the air flowing into the developing device 10 is properly discharged, the amount of discharged developer may decrease. In addition, under high-temperature/high-humidity environmental conditions where fluidity of the developer is the poorest, the amount of discharged developer may decrease excessively, which may excessively increase the amount of the developer in the developing device 10. If an amount of the developer in the developing device 10 is greater or less than an appropriate level, degradation in image quality and failure of the image forming apparatus in various forms may occur. Thus, there is a need for a method to reduce fluctuation in an amount of developer in the developing device 10 due to a change in printing speed or environmental conditions or the like.

FIG. 4 is a schematic structural diagram of a structure for reducing fluctuation in an amount of developer, according to an example. Referring to FIG. 4, a developer inlet 251 is provided in the developer transporting unit 201. The developer inlet 251 may be provided in, for example, the supply unit 221. The developer inlet 251 may be a developer supply inlet 250, and the developer inlet 251 may be provided in the supply unit 221 separately from the developer supply inlet 250. A developer circulator 300 selectively guides the developer discharged from the developer transporting unit 201 to the waste developer container 2 and the developer transporting unit 201. First and second connection openings 310 and 320 and a waste opening 330 are provided in the developer circulator 300. The first connection opening 310 is connected to the developer outlet 260, and the second connection opening 320 is an inlet into the developing device 10 and is connected to the developer inlet 251. The waste opening 330 is an inlet into the waste developer container 2 and is connected to the waste developer container 2. The developer circulator 300 includes a guide member 340 that selectively guides the developer received through the first connection opening 310 to the second connection opening 320 and the waste opening 330. The guide member 340 may selectively transport the developer to the second connection opening 320 and the waste opening 330 according to a rotational direction.

For example, the developer circulator 300 may extend in an axial direction of the developing roller 13. The guide member 340 may include a rotational shaft 341 extending in parallel with the developing roller 13 and a spiral wing 342 extending along the rotational shaft 341. This type of guide member 340 may be referred to as an auger. The guide member 340 may be connected to a driving motor (not shown) provided in the main body 1 to be driven when the developing device 10 is mounted in the main body 1. The guide member 340 may also be driven by an actuator 350 provided in the developing device 10. In this example, the actuator 350 may be, for example, a rotary motor.

The second connection opening 320 and the waste opening 330 are spaced apart from each other in an axial direction of the guide member 340. The first connection opening 310 may be located between the second connection opening 320 and the waste opening 330 with respect to the axial direction of the guide member 340.

According to this configuration, the developer in the developer transporting unit 201 is introduced into the developer circulator 300 through the developer outlet 260 and the first connection opening 310. The developer may be reintroduced into the developer transporting unit 201 through the second connection opening 320 or discharged to the waste developer container 2 through the waste opening 330 in accordance with a rotational direction of the guide member 340.

Whether the developer is to be reintroduced or to be discarded may be determined according to an amount of the developer in the developing device 10. The amount of the developer may be indirectly detected by detecting a concentration of toner in the developer. A level of the developer in the developing device 10 may also be directly detected. Referring to FIG. 2, a developer sensor 270 is provided in the developer transporting unit 201. The developer sensor 270 may be provided, for example, in the agitating chamber 220. The developer sensor 270 may be, for example, a toner concentration sensor for detecting a concentration of toner in the developer. The toner concentration may be expressed as a ratio of a weight of the toner to a total weight of the developer. The developer sensor 270 may be, for example, a magnetic sensor that indirectly detects a toner concentration by measuring an intensity of a magnetic force by a carrier. If an amount of carriers in a detection area of the developer sensor 270 is relatively large, and a toner amount is small, an intensity of a magnetic field detected by using the developer sensor 270 increases. Conversely, when a toner amount is relatively large in a detection area, an intensity of a magnetic field detected by using the developer sensor 270 decreases. The developer sensor 270 may detect a toner concentration based on a relationship between a detected magnetic field and a toner concentration. As another example, the developer sensor 270 may be a capacitance sensor that detects a toner concentration based on a difference in permittivity between the carrier and the toner. The developer sensor 270 may be a level sensor that detects a level of developer in the developer transporting unit 201. In this case, the developer sensor 270 may include a lifting plate (not shown) that is moved up and down according to a level of the developer and a sensor (optical sensor, microswitch, or the like) that detects a position of the lifting plate.

While printing is performed, the developer is discharged to the developer circulator 300 through the developer outlet 260. A controller 400 acquires a level value of the developer in the developing device 10 based on developer level information transmitted by the developer sensor 270. If a developer level value is higher than an appropriate value, the controller 400 drives the actuator 350 in a forward direction. Then the guide member 340 is rotated in a forward direction, and the developer in the developer circulator 300 is transported toward the waste opening 330 and discharged to the waste developer container 2 through the waste opening 330. If a developer level value is lower than the appropriate value, the controller 400 drives the actuator 350 in a reverse direction. Then the guide member 340 is rotated in a reverse direction, and the developer in the developer circulator 300 is transported toward the second connection opening 320 and re-introduced into the developer transporting unit 201 through the second connection opening 320 and the developer inlet 251.

According to this configuration, an amount of the developer in the developing device 10 may be stably maintained despite factors such as a printing speed or environmental conditions, and printing images of a stable quality may be obtained.

In the above-described example, the developer circulator 300 is provided in the developing device 10, but the present disclosure is not limited thereto. As shown by a dotted line in FIG. 4, the developer circulator 300 may also be provided in the waste developer container 2. The position of the developer circulator 300 is not limited to the position illustrated in FIG. 4. The developing device 10 may have various layouts, and the developer circulator 300 may also be located at various positions according to the layout of the developing device 10. For example, the developer inlet 251 is provided in the supply unit 221 extending from one of the developing chamber 210 and the agitating chamber 220, and the developer outlet 260 may be provided in the discharging unit 211 extending from the other of the developing chamber 210 and the agitating chamber 220. The first and second connection openings 310 and 320 of the developer circulator 300 and the waste opening 330 may also be formed at appropriate positions according to the positions of the developer outlet 260 and the developer inlet 251.

FIG. 5 is a schematic structural diagram of a structure for reducing fluctuation in an amount of developer, according to an example. Referring to FIG. 5, a developer circulator 300*a* is provided. The developer circulator 300*a* selectively guides the developer discharged from the developer transporting unit 201 to the waste developer container 2 or the developer transporting unit 201. First and second connection openings 310 and 320 and a waste opening 330 are provided in the developer circulator 300*a*. The first connection opening 310 is connected to the developer outlet 260, and the second connection opening 320 is connected to the developer inlet 251. The waste opening 330 is connected to the waste developer container 2. The developer circulator 300*a* includes a guide member 340*a* that selectively guides the developer received through the first connection opening 310 to the second connection opening 320 and the waste opening 330. The guide member 340*a* may selectively transport the developer to the second connection opening 320 and the waste opening 330 according to a rotational direction.

The developer circulator 300*a* is not parallel to an axial direction of the developing roller 13. For example, the developer circulator 300*a* may be configured to extend in a direction orthogonal to the axial direction of the developing roller 13. The guide member 340*a* may have a rotational shaft 341*a* and a transport wing 342*a* extending from the rotational shaft 341*a* in a radial direction. This type of guide member 340*a* may be referred to as a paddle. The rotational shaft 341*a* is not parallel to the axial direction of the developing roller 13. For example, the rotational shaft 341*a* may extend in a direction orthogonal to the axial direction of the developing roller 13. The guide member 340*a* may be connected to a driving motor (not shown) provided in the main body 1 to be driven when the developing device 10 is mounted in the main body 1. The guide member 340*a* may be driven by an actuator 350 provided in the developing device 10. In the present example, the actuator 350 may be, for example, a rotary motor. The second connection opening 320 and the waste opening 330 are spaced apart from each other in the rotational direction of the guide member 340*a*.

According to this configuration, the developer in the developer transporting unit 201 is introduced into the developer circulator 300*a* through the developer outlet 260 and the first connection opening 310. The developer may be reintroduced into the developer transporting unit 201 through the second connection opening 320 or discharged to the waste developer container 2 through the waste opening 330 according to the rotational direction of the guide member 340*a*.

While printing is performed, the developer is discharged to the developer circulator 300*a* through the developer outlet 260. The controller 400 acquires a level value of the developer in the developing device 10 based on developer level information transmitted by the developer sensor 270. If a developer level value is higher than an appropriate value, the controller 400 drives the actuator 350 in a forward direction. Then the guide member 340*a* is rotated in a forward direction, and the developer in the developer circulator 300*a* is transported toward the waste opening 330 and is discharged to the waste developer container 2 through the waste opening 330. If the developer level value is lower than the appropriate value, the controller 400 drives the actuator 350 in a reverse direction. Then the guide member 340*a* is rotated in a reverse direction, and the developer in the developer circulator 300*a* is transported toward the second connection opening 320 and is reintroduced into the developer transporting unit 201 through the second connection opening 320 and the developer inlet 251.

According to this configuration, the amount of the developer in the developing device 10 may be stably maintained despite factors such as a printing speed or environmental conditions, and printing images of a stable quality may be obtained.

Although the developer circulator 300*a* is provided in the developing device 10 in the above-described example, the present disclosure is not limited thereto. As shown by a dotted line in FIG. 5, the developer circulator 300*a* may also be provided in the waste developer container 2.

FIG. 6 is a schematic structural diagram of a structure for reducing fluctuation in an amount of developer, according to an example. Referring to FIG. 6, first and second connection openings 310 and 320 and a waste opening 330 are provided in a developer circulator 300*b*. The first connection opening 310 is connected to the developer outlet 260, and the second connection opening 320 is connected to the developer inlet 251. The waste opening 330 is connected to the waste developer container 2. The developer circulator 300*b* includes a guide member 340*b* that selectively guides the developer received through the first connection opening 310 to the second connection opening 320 or the waste opening 330. The guide member 340*b* may selectively transport the developer to the second connection opening 320 and the waste opening 330 according to a rotational direction.

The developer circulator 300*b* is parallel to an axial direction of the developing roller 13. For example, the developer circulator 300*b* may extend in the axial direction of the developing roller 13. The guide member 340*b* may include a rotational shaft 341*b* and a transport wing 342*b* extending from the rotational shaft 341*b* in a radial direction. This type of guide member 340*b* may be referred to as a paddle. The rotational shaft 341*b* is parallel to the axial direction of the developing roller 13. The guide member 340*b* may be connected to a driving motor (not shown) provided in the main body 1 to be driven when the developing device 10 is mounted in the main body 1. The guide member 340*b* may be driven by an actuator 350 provided in the developing device 10. In the present example, the actuator 350 may be, for example, a rotary motor. The second connection opening 320 and the waste opening 330 are spaced apart from each other in a rotational direction of the guide member 340*b*.

According to this configuration, the developer in the developer transporting unit 201 is introduced into the developer circulator 300*b* through the developer outlet 260 and the first connection opening 310. The developer may be reintroduced into the developer transporting unit 201 through the second connection opening 320 or discharged to the waste developer container 2 through the waste opening 330 according to the rotational direction of the guide member 340*b*.

While printing is performed, the developer is discharged to the developer circulator 300*b* through the developer outlet 260. The controller 400 acquires a level value of the developer in the developing device 10 based on developer level information transmitted by the developer sensor 270. If a developer level value is higher than an appropriate value, the controller 400 drives the actuator 350 in a forward direction. Then the guide member 340*b* is rotated in a forward direction, and the developer in the developer circulator 300*b* is transported to the waste opening 330, and is discharged to the waste developer container 2 through the waste opening 330. If a developer level value is lower than the appropriate value, the controller 400 drives the actuator 350 in a reverse direction. Then the guide member 340*b* is rotated in a reverse direction, and the developer in the developer circulator 300*b* is transported toward the second connection opening 320, and is reintroduced into the developer transporting unit 201 through the second connection opening 320 and the developer inlet 251.

Although the developer circulator 300*b* is provided in the developing device 10 in the above-described example, the present disclosure is not limited thereto. As illustrated by a dotted line in FIG. 6, the developer circulator 300*b* may be provided in the waste developer container 2.

FIGS. 7 and 8 are schematic structural diagrams of an example of a structure for reducing fluctuation in an amount of developer. Referring to FIGS. 7 and 8, first and second connection openings 310 and 320 and a waste opening 330 are provided in a developer circulator 300*c*. The first connection opening 310 is connected to the developer outlet 260, and the second connection opening 320 is connected to the developer inlet 251. The waste opening 330 is connected to the waste developer container 2. The developer circulator 300*c* includes a guide member 340*c* that selectively guides the developer received through the first connection opening 310 to the second connection opening 320 or the waste opening 330.

The developer circulator 300*c* is parallel to an axial direction of the developing roller 13. For example, the developer circulator 300*c* may extend in an axial direction of the developing roller 13. The guide member 340*c* is a valve member having a switching shaft 341*c* and a pair of guide wings 342*c* extending from the switching shaft 341*c*. Hereinafter, the guide member 340*c* will be referred to as a valve member 340*c*.

The valve member 340*c* may be connected to a driving motor (not shown) provided in the main body 1 and driven when the developing device 10 is mounted in the main body 1. The valve member 340*c* may be driven by an actuator 350 provided in the developing device 10. In the present example, the actuator 350 may be, for example, a solenoid actuator. The valve member 340*c* may be switched, by the actuator 350, to a first position (FIG. 7) where the first connection opening 310 and the second connection opening 320 are connected and a second position (FIG. 8) where the first connection opening 310 and the waste opening 330 are connected.

According to this configuration, the developer in the developer transporting unit 201 is introduced into the developer circulator 300*c* through the developer outlet 260 and the first connection opening 310. When the valve member 340*c* is located at the first position, the developer introduced into the developer circulator 300*c* through the first connection opening 310 is guided to the second connection opening 320 via the valve member 340*c*, and introduced into the developer transporting unit 201 through the developer inlet 251. When the valve member 340*c* is located at the second position, the developer introduced into the developer circulator 300*c* through the first connection opening 310 is guided to the waste opening 330 via the valve member 340*c*, and is discharged to the waste developer container 2.

While printing is performed, the developer is discharged to the developer circulator 300*c* through the developer outlet 260. The controller 400 obtains a level value of the developer in the developing device 10 based on developer level information transmitted by the developer sensor 270. If a developer level value is higher than an appropriate value, the controller 400 drives the actuator 350 to locate the valve member 340*c* in the second position as shown in FIG. 8. Then the developer in the developer circulator 300*c* is guided toward the waste opening 330 and discharged to the waste developer container 2 through the waste opening 330. If a developer level value is lower than the appropriate value, the controller 400 drives the actuator 350 to switch the valve member 340*c* to the first position as shown in FIG. 7. The developer in the developer circulator 300*c* is guided toward the second connection opening 320 and reintroduced into the developer transporting unit 201 through the second connection opening 320 and the developer inlet 251.

While the developer circulator 300*c* is provided in the developing device 10 is described in the above example, the present disclosure is not limited thereto. As illustrated by a dotted line in FIG. 7, the developer circulator 300*c* may also be provided in the waste developer container 2.

While the present disclosure has been particularly shown and described with reference to examples thereof, it will be understood by those of ordinary skill in the art that various changes in form and details may be made therein without departing from the spirit and scope of the present disclosure as defined by the following claims.

The invention claimed is:

1. A developing device comprising:

a developer transporting unit to agitate and transport a developer, the developer transporting unit comprising:

a developer inlet to introduce the developer into the developer transporting unit, a developer outlet to discharge the developer from the developer transporting unit, and a developing roller mounted in the developer transporting unit; and a developer circulator comprising:

a first connection opening connected to the developer outlet, to receive the developer discharged through the developer outlet, a second connection opening connected to the developer inlet, to introduce the developer through the developer inlet into the developer transporting unit, a waste opening to discard the developer from the developer transporting unit, and a guide member mounted in the developer circulator to selectively guide the developer received through the first connection opening to the second connection opening or to the waste opening.

2. The developing device of claim 1, wherein the guide member is rotatable to selectively transport the developer toward the second connection opening or toward the waste opening, according to a rotational direction of the guide member.

3. The developing device of claim 2, wherein the guide member includes a rotational shaft and a spiral wing, the rotational shaft extending in parallel with the developing roller, and the spiral wing extending along the rotational shaft, wherein the second connection opening and the waste opening are spaced apart from each other in an axial direction of the guide member.

4. The developing device of claim 1, wherein the first connection opening is between the second connection opening and the waste opening.

5. The developing device of claim 2, wherein the guide member includes a rotational shaft and a transport wing extending from the rotational shaft in a radial direction, wherein the second connection opening and the waste opening are spaced apart from each other in a rotational direction of the rotational shaft included in the guide member.

6. The developing device of claim 5, wherein the rotational shaft is in parallel with the developing roller.

7. The developing device of claim 5, wherein the rotational shaft is other than in parallel with the developing roller.

8. The developing roller of claim 1, wherein the guide member comprises a valve to switch between a first position to connect the first connection opening and the second connection opening, and a second position to connect the first connection opening and the waste opening.

9. The developing device of claim 1, wherein the developer transporting unit comprises:

a developing chamber extending in a length direction of the developing roller, the developing roller being mounted in the developing chamber;

an agitating chamber that is in parallel with the developing chamber; and a barrier wall that divides the developing chamber and the agitating chamber, the barrier wall having a first opening and a second opening formed in two respective end portions of the barrier wall, to communicatively connect the developing chamber and the agitating chamber, wherein the developer inlet is provided in a supply unit to introduce the developer into the developer transporting unit, the developer outlet is provided in a discharging unit to discharge the developer from the developer transporting unit, the supply unit extends from the developing chamber or the agitating chamber, and the discharging unit extends from the developing chamber or the agitating chamber, from which the supply unit is not extending.

10. An electrophotographic image forming apparatus comprising:

a photosensitive body to form an electrostatistically charged portion;

a developing device to supply a developer to the electrostatistically charged portion to develop an image and discharge the developer;

a waste developer container; and a developer circulator to selectively guide the developer discharged from the developing device to the waste developer container or to the developing device, wherein the developer circulator comprises a rotatable member, the rotatable member when rotated in a first direction guides the developer discharged from the developing device to the waste developer container, and the rotatable member when rotated in a second direction guides the developer discharged from the developing device back to the developing device, the second direction being different from the first direction.

11. The electrophotographic image forming apparatus of claim 10, wherein the developing device comprises:

a developing transporting unit to agitate and transport the developer, the developing transporting unit comprising:

a developer inlet to introduce the developer to the developer transporting unit, a developer outlet to discharge the developer from the developer transporting unit, and a developing roller mounted in the developer transporting unit, and wherein the developer circulator comprises:

a first connection opening connected to the developer outlet, to receive the developer discharged through the developer outlet, a second connection opening connected to the developer inlet, to introduce the developer through the developer inlet into the developer transporting unit, a waste opening through which the developer is discarded to the waste developer container, and a guide member comprising the rotatable member.

12. An electrophotographic image forming apparatus comprising:

a photosensitive body to form an electrostatistically charged portion;

a developing device to supply a developer to the electrostatistically charged portion to develop an image and discharge the developer;

a waste developer container; and a developer circulator to selectively guide the developer discharged from the developing device to the waste developer container or to the developing device, wherein the developing device comprises a developing transporting unit to agitate and transport the developer, the developing transporting unit comprising:

a developer inlet to introduce the developer to the developer transporting unit, a developer outlet to discharge the developer from the developer transporting unit, and a developing roller mounted in the developer transporting unit, and wherein the developer circulator comprises:

a first connection opening connected to the developer outlet, to receive the developer discharged through the developer outlet, a second connection opening connected to the developer inlet, to introduce the developer through the developer inlet into the developer transporting unit, a waste opening to discard the developer to the waste developer container, and a guide member to selectively guide the developer received through the first connection opening to the second connection opening or to the waste opening, wherein the guide member comprises a valve to switch between:

a first position to connect the first connection opening and the second connection opening, and a second position to connect the first connection opening and the waste opening.

13. The electrophotographic image forming apparatus of claim 10, wherein the developer circulator is provided in the developing device.

14. The electrophotographic image forming apparatus of claim 10, wherein the developer circulator is provided in the waste developer container.

15. The electrophotographic image forming apparatus of claim 10, wherein the rotatable member comprises a rotatable shaft and a spiral wing extending along an axial direction of the rotatable member.

16. The electrophotographic image forming apparatus of claim 10, wherein the rotatable member comprises a rotatable shaft and transport wings extending radially from the rotatable shaft.

17. The electrophotographic image forming apparatus of claim 10, wherein the rotatable member comprises a paddle.

18. The electrophotographic image forming apparatus of claim 10, wherein the rotatable member extends along an axial direction, wherein the developer circulator comprises:

a first opening to receive the developer from the developing device, a second opening to discharge the developer back to the developing device, and a third opening to discharge the developer to the waste developer container, wherein the first opening is positioned between the second opening and a waste opening along the axial direction.

* * * * *